US005911321A

United States Patent [19]

Brinkmann

[11] Patent Number: 5,911,321

[45] Date of Patent: Jun. 15, 1999

[54] PACKING UNIT AND METHOD FOR ITS MANUFACTURE

[75] Inventor: Fritz Brinkmann, Buchen, Germany

[73] Assignee: Pacimex Verpackungen GmbH, Scheyern, Germany

[21] Appl. No.: 08/578,604

[22] PCT Filed: Jun. 7, 1994

[86] PCT No.: PCT/EP94/01852

§ 371 Date: Jan. 4, 1996

§ 102(e) Date: Jan. 4, 1996

[87] PCT Pub. No.: WO95/33661

PCT Pub. Date: Dec. 14, 1995

[51] Int. Cl.[6] ..... A41D 19/00; B65D 73/00

[52] U.S. Cl. ..... 206/278; 206/390; 229/87.16; 2/169; 156/251

[58] Field of Search ..... 206/278, 460, 206/390; 229/87.16, 87.15; 2/159, 161.7; 156/251

[56] References Cited

U.S. PATENT DOCUMENTS

| | | | |
|---|---|---|---|
| 2,732,934 | 1/1956 | Hall | 206/278 |
| 2,893,546 | 7/1959 | Kendall et al. | 206/278 |
| 2,915,173 | 12/1959 | Langdon | 229/87.16 X |
| 3,384,225 | 5/1968 | Nye | 206/278 |
| 3,391,855 | 7/1968 | Ansell | 206/278 X |
| 3,923,577 | 12/1975 | Baab | 206/278 X |
| 3,966,045 | 6/1976 | Perdue | 206/443 |
| 4,034,853 | 7/1977 | Smith | 206/390 X |
| 4,094,120 | 6/1978 | Goncalves | 229/87.16 X |
| 4,476,588 | 10/1984 | Long | 2/159 X |
| 4,863,084 | 9/1989 | Nabozny | 206/278 X |
| 5,522,499 | 6/1996 | DeBiasio et al. | 229/87.16 X |

FOREIGN PATENT DOCUMENTS

| | | | |
|---|---|---|---|
| 1100452 | 5/1981 | Canada | 2/159 |
| 2 164 540 | 3/1986 | United Kingdom . | |
| 8900385 | 1/1989 | WIPO | 2/159 |

*Primary Examiner*—Sue A. Weaver
*Attorney, Agent, or Firm*—Antonelli, Terry, Stout & Kraus, LLP

[57] ABSTRACT

A packing unit with two protective gloves arranged on a carrier sheet, particularly AIDS protective gloves characterized in that both protective gloves are attached to one side of carrier sheet and/or to an opposite side of the carrier sheet such that the contour outlines of the two protective gloves overlap at least partially.

10 Claims, 1 Drawing Sheet

PACKING UNIT AND METHOD FOR ITS MANUFACTURE

FIELD OF THE INVENTION

The present invention relates to a packing unit with two protective gloves, particularly AIDS protective gloves, located on a carrier sheet and a method for manufacturing same.

BACKGROUND OF THE INVENTION

Packing units for protective gloves are known in which the gloves are attached next to each other on a carrier sheet made of paper for example. Information for the wearer of the protective gloves, for example their use in treating persons suspected of having AIDS, can be printed on the carrier sheet. To protect the sensitive gloves, which consist of thin plastic film, from damage, it is necessary to attach the gloves flat to the carrier sheet. Accordingly, attachment of two gloves next to each other requires a large carrier sheet, the size of which corresponds at least to the contour outlines of two gloves lying next to each other. A carrier sheet the size of DIN A3 format is generally necessary for this. Consequently, packing units for two protective gloves on a carrier sheet require a great deal of paper.

SUMMARY OF THE INVENTION

The goal of the present invention is to create a packing unit in which the material requirement for the carrier sheet can be reduced with two protective gloves, especially AIDS protective gloves, disposed on a carrier sheet.

This goal is achieved by a packing unit of the species according to the preamble of the main claim with the features of its characterizing portion. The subclaims contain preferred embodiments of the invention and a method for manufacturing the packing unit.

BRIEF DESCRIPTION OF THE FIGURES

The invention will now be described in further detail with reference to the figures.

DESCRIPTION OF THE PREFERRED EMBODIMENT

The present invention offers two possibilities for reducing the material requirement for the carrier sheet, which can consist of paper for example. The first is for the two protective gloves to be located and attached on opposite sides of the carrier sheet; the second is for the two protective gloves to be located on the same side of the carrier sheet and attached. In both cases, the contour outlines of the protective gloves overlap at least partially, so that with increasing overlapping the space taken up by the protective gloves is reduced. Thus, it is preferable for the contour outlines of the two gloves to overlap the total outline to a considerable degree, and especially preferable for them to be completely or nearly congruent.

When the protective gloves are located on opposite sides of the carrier sheet, the protective gloves are preferably of the same size, i.e. the contour outlines of the two protective gloves located on opposite sides of the carrier sheet are identical. In the second arrangement, namely placing the two protective gloves on the same side of the carrier sheet, it is preferable for the contour outlines of the protective glove located further from the carrier sheet to be slightly larger than the protective glove abutting the sheet. In this manner, when the protective gloves are manufactured by a heat-sealed seam, initially the protective glove abutting the carrier sheet can be sealed from two layers of film, whereupon the second protective glove is sealed above the first protective glove in the same manner. Because the protective glove that is further from the carrier sheet has a slightly larger contour outline, heat sealing can be performed on this protective glove without said protective glove sticking to the protective glove beneath. However, an antisealing layer can be applied to the lower protective glove and the second protective glove placed on it, and sealed. In this case, the contour outlines of the two superimposed protective gloves can also be identical.

The protective gloves can be sealed using known methods, for example by gluing or the above-mentioned hot sealing.

Carrier sheet 16 made of paper or a similar material has the normal rectangular contour; it is a DIN A4 format sheet. A protective glove 12 is attached to carrier sheet 16, for example by gluing at a few spots or by a heat-sealing method. Protective glove 12 consists of a transparent polyethylene film as is the second protective glove 14 on top of it, namely further way from carrier sheet 16. This protective glove 14, which also consists of transparent polyethylene film, has a somewhat larger contour outline than protective glove 12 underneath it, namely lying on carrier sheet 16.

Figure 1:
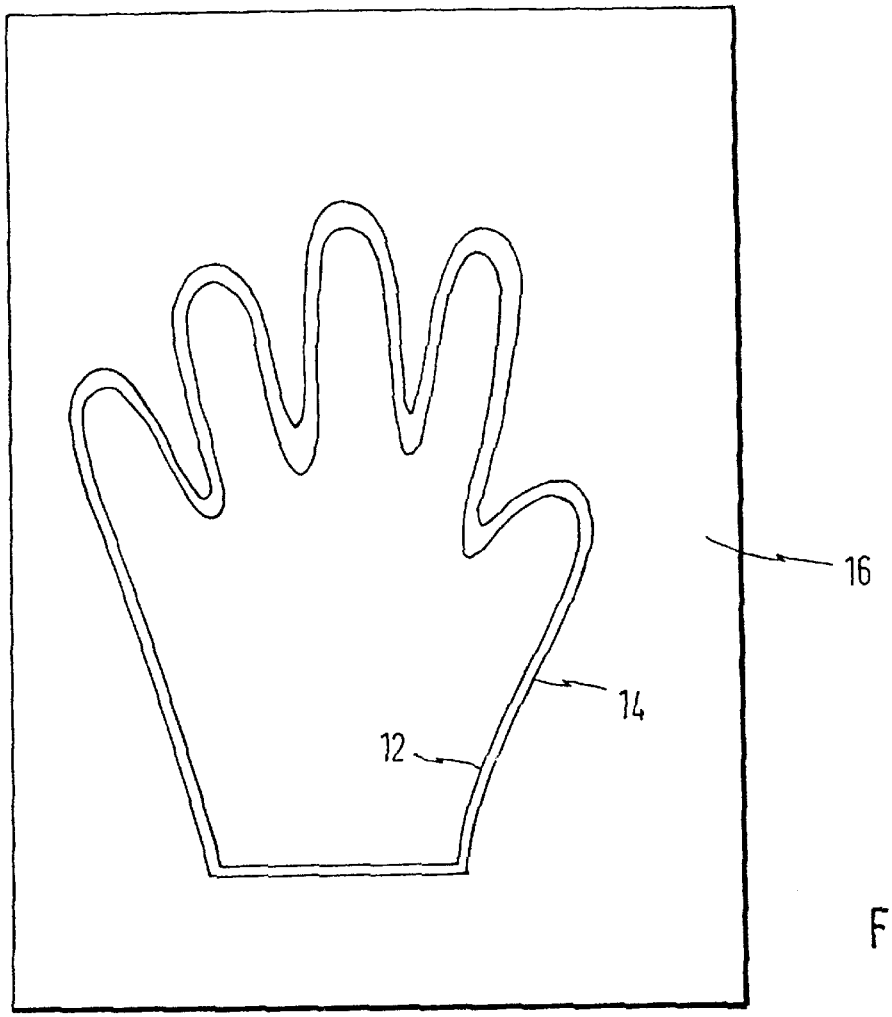
FIG. 1 is a carrier sheet with two mounted protective gloves with different contour outlines in top view.
Figure 2:
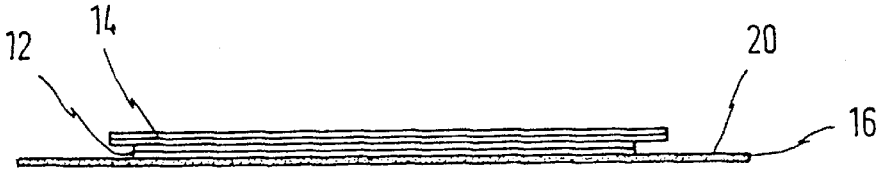
FIG. 2 is a section through the arrangement of FIG. 1 showing a sequence of superimposed film layers which may be simultaneously heat sealed or glued to the carrier sheet when preparing a packing unit of a pair of gloves.

The layer structure can be seen in FIG. 2. Carrier sheet 16 supports first the two film layers of first protective glove 12, while over them the other two film layers of protective glove 14 with a somewhat larger contour outline can be seen.

Figure 3:
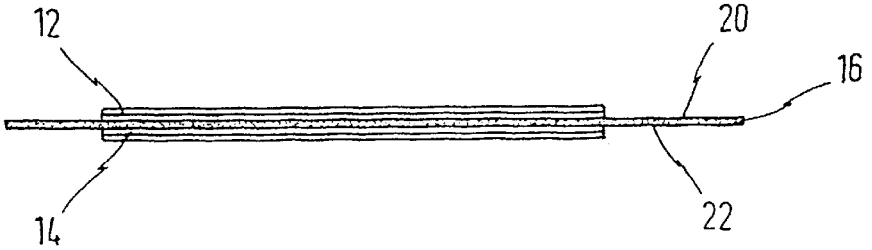
FIG. 3 is a further embodiment in which the film layers of two protective gloves are located on opposite sides of the carrier sheet and which film layers may be simultaneously heat sealed or glued to the carrier sheet when preparing a packing unit of a pair of gloves.

FIG. 3 shows an arrangement in which the two protective gloves 12, 14 are located on opposite sides 20 and 22 of carrier sheet 16.

The packing units can be made as follows: first, the film layers, namely two layers for each protective glove 12, 14 are arranged either on one side of the carrier sheet, as shown in FIG. 2, or on opposite sides of the carrier sheet, as shown in FIG. 3. Then the edges of the film layers, except for the edge at the wrist, are bonded together, by heat sealing for example. A loose, releasable connection between the two protective gloves 12, 14 with carrier sheet 16 is formed at the same time.

We claim:

1. Packing unit with an entire contour of two protective gloves arranged on a carrier sheet, wherein both protective gloves are attached to one side of the carrier sheet such that the contour outlines of the two protective gloves overlap, at least partially.

2. Packing unit according to claim 1, wherein substantially an entirety of the contour outlines of the two protective gloves overlap.

3. Packing unit according to claim 1, wherein both protective gloves have the same contour outlines.

4. Packing unit according to claim 1 or 2, wherein both protective gloves are attached to the same side of the carrier sheet.

5. Packing unit with an entire contour of two protective gloves arranged on a carrier sheet wherein both protective gloves are attached to the same side of the carrier sheet such that the contour outlines of the two protective gloves overlap, at least partially, and wherein the protective glove further away from the carrier sheet has a larger contour outline than the protective glove abutting the carrier sheet.

6. Packing unit according to claim 5, wherein the protective gloves are AIDS protective gloves.

7. Packing unit with an entire contour of two protective gloves arranged on a carrier sheet, wherein both protective gloves are attached respectively to opposite sides of the carrier sheet such that the contour outlines of the two protective gloves overlap, at least partially.

8. Packing unit according to claim 7, wherein both protective gloves have the same contour outlines.

9. A packing unit prepared by a process comprising the steps of superimposing four film layers which form top and bottom sides of a pair of protective gloves, and one carrier sheet on one another such that the carrier sheet and a film layer furthest from the carrier sheet are attached at the same time the film layers are joined to form the pair of protective gloves.

10. A packing unit prepared by a process comprising the steps of superimposing four film layers which form top and bottom sides of a pair of protective gloves, and one carrier sheet on one another such that the carrier sheet and a film layer abutting the carrier sheet are attached at the same time the film layers are joined to form the pair of protective gloves.

* * * * *